US008959892B2

(12) United States Patent
McCoy et al.

(10) Patent No.: US 8,959,892 B2
(45) Date of Patent: Feb. 24, 2015

(54) EXHAUST SYSTEM HAVING SENSOR PLACEMENT DETECTION

(71) Applicant: Caterpillar Inc., Peoria, IL (US)

(72) Inventors: Darin James McCoy, Peoria, IL (US); Drew Douglas Wackerlin, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 91 days.

(21) Appl. No.: 13/749,880

(22) Filed: Jan. 25, 2013

(65) Prior Publication Data

US 2014/0208716 A1 Jul. 31, 2014

(51) Int. Cl.
*F01N 3/00* (2006.01)
*F02D 41/22* (2006.01)

(52) U.S. Cl.
CPC ..... *F02D 41/22* (2013.01)
USPC ..... 60/277; 60/274; 701/109

(58) Field of Classification Search
CPC ..... F02D 41/222; F02D 41/1495; F01N 2550/00; F01N 9/00; F01N 11/00; F01N 2560/02; Y02T 10/47
USPC ..... 60/272–324
See application file for complete search history.

(56) References Cited

U.S. PATENT DOCUMENTS

| | | | | |
|---|---|---|---|---|
| 5,528,932 | A * | 6/1996 | Bauer et al. | 73/114.73 |
| 6,092,413 | A * | 7/2000 | Busch et al. | 73/114.73 |
| 6,167,754 | B1 * | 1/2001 | Koenders | 73/114.73 |
| 6,843,240 | B1 | 1/2005 | Hahn et al. | |
| 6,961,653 | B2 * | 11/2005 | Maki | 701/109 |
| 7,558,667 | B2 * | 7/2009 | Kida | 701/114 |
| 7,891,177 | B2 * | 2/2011 | Ammineni et al. | 60/297 |
| 8,554,444 | B2 * | 10/2013 | Hasslacher et al. | 701/99 |

* cited by examiner

*Primary Examiner* — Jesse Bogue
(74) *Attorney, Agent, or Firm* — Finnegan, Henderson, L.L.P.

(57) ABSTRACT

An exhaust control system for use with a combustion engine is disclosed. The system may have an exhaust passage, an exhaust sensor located within the exhaust passage and configured to generate a first signal indicative of an exhaust parameter, and an operational sensor associated with the combustion engine and configured to generate a second signal indicative of an operational parameter. The system may have a controller associated with the combustion engine, the exhaust sensor, and the operational sensor. The controller may be configured to detect a change in the operational parameter based on the second signal and to detect a change in the exhaust parameter based on the first signal. The controller may measure an elapsed time between detection of the change in the operational parameter and the change in the exhaust parameter, and determine a placement-related parameter of the exhaust sensor based on the elapsed time.

18 Claims, 2 Drawing Sheets

EXHAUST SYSTEM HAVING SENSOR PLACEMENT DETECTION

TECHNICAL FIELD

The present disclosure is directed to an exhaust system and, more particularly, to an exhaust system that determines a placement-related parameter of a sensor.

BACKGROUND

Internal combustion engines, including diesel engines, gasoline engines, gaseous fuel-powered engines, and other engines known in the art, exhaust a complex mixture of air pollutants. These air pollutants are composed of gaseous compounds such as, for example, oxides of nitrogen ($NO_x$). Due to harmful effects of these pollutants, exhaust emission standards have become more stringent, and the amount of $NO_x$ emitted from an engine may be regulated. In order to regulate the amount of $NO_x$ and other gas emissions, exhaust systems rely on gas sensors. Some uses of these gas sensors require accurate information about the location of the gas sensors relative to the engine.

Sometimes the precise location of a gas sensor is not known, and instead, is based on an assumption or an estimate. For example, the manufacturer of the engine or the exhaust system may not be the installer of the system, and there is no guarantee that specifications for the placement of the gas sensor have been met during installation. In some situations, such as when the gas sensor is not where the manufacturer expects it to be, signals from the sensor cannot be relied upon for properly operating the exhaust system and/or detecting the concentration of gaseous compounds in the exhaust system.

Improperly or poorly positioned sensors can often be mischaracterized as being faulty, and engine manufacturers often utilize systems configured to detect faulty sensors. For example, one system configured to detect a faulty $NO_x$ sensor is described in U.S. Pat. No. 6,843,240 B1 (the '240 patent) issued to Hahn et al. on Jan. 18, 2005. The '240 patent discloses an exhaust system that monitors the function of a $NO_x$ sensor arranged in an exhaust duct. For example, the system compares an accumulative measure of the actual mass absorbed by a $NO_x$ storage catalytic converter with a target mass calculated based on a model for the $NO_x$ storage catalytic converter. The ratio of the actual mass to the target mass is then compared to predetermined limits to determine whether the $NO_x$ sensor is functioning. The '240 patent also discloses an alternative method of comparing a measured regeneration time of the $NO_x$ storage catalytic converter with a target regeneration time calculated based on a model for the $NO_x$ storage catalytic converter.

Although the system described in the '240 patent may be capable of determining the functionality of a $NO_x$ sensor, the system is not configured to detect whether a properly operating gas sensor has been installed incorrectly or in the wrong location.

The system of the present disclosure solves one or more of the problems set forth above and/or other problems.

SUMMARY

In one aspect, the present disclosure is directed to an exhaust control system for use with a combustion engine. The exhaust control system may include an exhaust passage configured to receive a flow of exhaust gas from the combustion engine. The exhaust control system may include an exhaust sensor associated with the exhaust passage and configured to generate a first signal indicative of an exhaust parameter of the exhaust gas. The exhaust control system may include an operational sensor associated with the combustion engine and configured to generate a second signal indicative of an operational parameter of the combustion engine. The exhaust control system may also include a controller associated with the combustion engine, the exhaust sensor, and the operational sensor. The controller may be configured to detect a change in the operational parameter of the combustion engine based on the second signal. The controller may be configured to detect a change in the exhaust parameter of the exhaust gas based on the first signal. The controller may be configured to determine a time elapsed between detection of the change in the operational parameter and the detection of change in the exhaust parameter. The controller may also be configured to determine a placement-related parameter of the exhaust sensor based on the elapsed time.

In another aspect, the present disclosure is directed to a method of determining a placement-related parameter of an exhaust control system. The method may include determining a change in an operational parameter of an engine and determining a change in an exhaust parameter of an exhaust of the engine at a location downstream of the engine. The method may also include measuring an elapsed time between determining the change in the operational parameter and determining the change in the exhaust parameter. The method may include determining the placement-related parameter based on the elapsed time.

DETAILED DESCRIPTION

Figure 1:
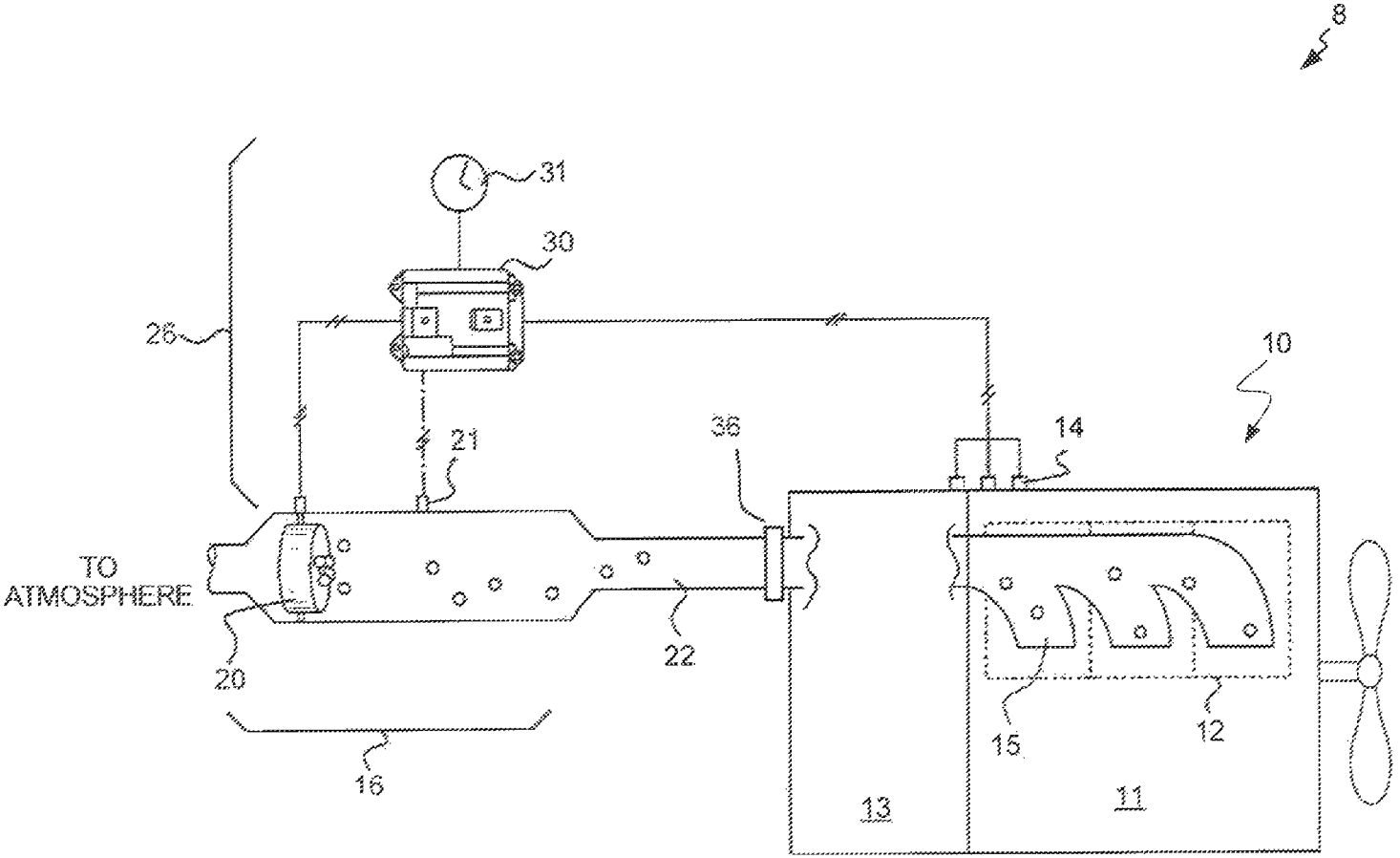
FIG. 1 is a diagrammatic illustration of an exemplary exhaust control system.

FIG. 1 illustrates an exemplary exhaust control system 8 having an exemplary power source 10, exhaust apparatus 16, and control sub-unit 26. For the purposes of this disclosure, power source 10 is depicted and described as a diesel-fueled, internal combustion engine. However, it is contemplated that power source 10 may embody any other type of combustion engine such as, for example, a gasoline or a gaseous fuel-powered engine. Power source 10 may include an engine block 11 that at least partially defines a plurality of cylinders 12. It is contemplated that power source 10 may include any number of cylinders 12, and that cylinders 12 may be disposed in an "in-line" configuration, a "V" configuration, or any other conventional configuration. Power source 10 may operate by receiving a fuel, such as diesel or gasoline, that undergoes combustion thereby generating forces on mechanical parts of engine block 11. As a result of the combustion processes, power source 10 may generate unwanted products such as $NO_x$, oxides of sulfur ($SO_x$), and uncombusted hydrocarbons, which comprise part of an exhaust gas. The exhaust gas may include other components such as water vapor, oxygen, nitrogen, carbon dioxide, and particulate matter such as soot. In some embodiments, power source 10 may include a turbocharger 13. Turbocharger 13 may include a turbine and a compressor (not shown). The turbine may receive the exhaust gas and direct it to an exhaust passage 22. The turbine may be connected to a compressor via at least one common shaft. As the turbine turns due to receiving the exhaust gas, the turbine turns a compressor wheel in the compressor, thereby causing the compressor to draw in ambient air. The compressor compresses the air and directs it to the engine. An exhaust gas recirculation line may be connected downstream of the turbine, and the recirculation line may be configured to direct a portion of the exhaust gas back to the engine along with the compressed intake air.

In various embodiments, power source 10 may include one or more operational sensors 14 that may embody any type of sensor configured to monitor an operational parameter of power source 10. Operational parameter may be any parameter that relates to the functioning of power source 10 such as, for example, power source speed, rate of fuel injection, air/fuel intake ratio, air flow, engine temperature, exhaust gas temperature, and/or exhaust gas pressure. For example, operational sensor 14 may be a sensor that generates a signal indicative of the speed of power source 10, and sends this signal as an input to a controller 30 of control sub-unit 26. In such an example, when the signal indicates a power source speed lower than a threshold speed, the signal may be an indication that power source 10 is operating at idle, and controller 30 may determine that power source 10 is operating in a non-fueling or low-fueling state based on such a signal. When the signal indicates a power source speed higher than a threshold speed, the signal may be an indication that power source 10 is operating in a high-fueling state.

In another example, operational sensor 14 may be a sensor that detects the amount of fuel being consumed by power source 10. In such embodiments, fuel consumption may be an operational parameter, and controller 30 may in turn use one or more signals indicative of fuel consumption to determine the fueling state of power source 10. For example, in some embodiments, operational sensor 14 may comprise more than one type of sensor and/or measuring device that is in communication with controller 30 to determine the rate and/or volume of fuel injection. For example, operational sensor 14 may comprise a pressure sensor that determines the pressure of high-pressure stored fuel behind one or more closed fuel injectors and a high-speed clock that determines how long one or more of the fuel injectors is operated to allow fuel to flow out of the fuel injectors. In further embodiments, it is contemplated that the fueling state of power source 10 may be determined based on command signals instead of sensor signals. For example, controller 30 may receive an operator input via one or more pedals, knobs, levers, wheels, and/or other like operator interface devices (not shown) associated with a machine to which exhaust control system 8 is connected. For example, such an operator interface device may include an accelerator pedal. In response to the operator depressing the accelerator pedal, controller 30 may send a fueling command to fuel injectors associated with power source 10. In such embodiments, controller 30 may determine that power source 10 is in a high-fueling state based on receiving the input command signal.

In still further embodiments, operational sensor 14 may be a temperature sensor configured to measure a temperature of the exhaust gas exiting power source 10 and/or a pressure sensor configured to measure a pressure of the exhaust gas exiting power source 10. In some embodiments, the measured pressure and/or temperature may be used to calculate a mass flow rate of the exhaust gas, where mass flow rate is a measure of the mass of the exhaust gas flowing through a fixed point in the exhaust passage 22 in a given amount of time. In other embodiments, operational sensor 14 may be a mass flow sensor that directly measures the mass flow rate of the exhaust gas.

Exhaust apparatus 16 may be fluidly connected and/or otherwise associated with power source 10 such that exhaust apparatus 16 may receive exhaust gas emitted by power source 10. In some embodiments, exhaust apparatus 16 and power source 10 may together comprise a power system that drives a machine, such as a truck, a wheel loader, a passenger vehicle, or any other engine-driven machine. Exhaust apparatus 16 may receive the exhaust gas from cylinders 12 by way of an exhaust manifold 15. Exhaust apparatus 16 may include components that condition and direct the exhaust gas collected by exhaust manifold 15 to the atmosphere. For example, exhaust apparatus 16 may include one or more exhaust treatment devices 20 and exhaust sensors 21 disposed within an exhaust passage 22 downstream of exhaust manifold 15. Exhaust treatment device 20 may be any device that interacts with the exhaust gas in exhaust passage 22 and treats the exhaust gas, either physically or chemically. Examples of exhaust treatment devices 20 may be a catalytic converter, particulate filter, selective reduction catalyst (SRC), ammonia oxidation catalyst, diesel oxidation catalyst (DOC), and/or an additive or reductant injector. In exemplary embodiments, the DOC may include a porous ceramic honeycomb structure or metal mesh substrate coated or otherwise impregnated with a material that catalyzes a chemical reaction, such as oxidation, to alter the pollutants in the exhaust gas. In other exemplary embodiments, the SCR may include an injector that injects reductant fluid into exhaust passage 22. In the presence of hot exhaust gas and a catalyst, the reductant fluid may catalytically reduce $NO_x$, or other constituents of the exhaust gas, into water vapor and nitrogen, for example. In some embodiments, the reductant fluid is ammonia or urea. The reductant fluid may be injected into the exhaust gas and/or onto the catalyst in a measured amount. Exhaust treatment device 20 may receive the exhaust gas directly from power source 10 or may receive the exhaust gas from other treatment devices interposed between exhaust treatment device 20 and power source 10.

Exhaust sensor 21 may embody any type of sensor that measures an exhaust parameter such as, for example, the presence and/or concentration of a constituent (e.g., $NO_x$, $SO_x$, and/or $O_2$) of the exhaust gas. The exhaust parameter may be any parameter that relates to the exhaust gas as measured by exhaust sensor 21, including a concentration of a constituent of the exhaust gas, temperature of the exhaust gas, and/or pressure of the exhaust gas, for example. An exemplary exhaust sensor 21 may be a gas sensor configured to sense $O_2$, $NO_x$, or any other gas that is of interest in the operation of power source 10. In various embodiments, exhaust sensor 21 may be a ceramic-type sensor designed to operate in the high temperatures found in exhaust apparatus 16. Exhaust sensor 21 may be located anywhere along exhaust passage 22. It is contemplated that exhaust apparatus 16 may include different or additional components than those described above such as, for example, energy extraction devices, bypass components, braking devices, attenuation devices, additional treatment devices, and other known components. As will be described, in some embodiments, exhaust treatment device 20 may be operated by control sub-unit 26.

Controller 30 may embody a single microprocessor or multiple microprocessors that include a means for controlling various aspects of operation of power source 10. Numerous commercially available microprocessors can be configured to perform the functions of controller 30. It should be appreciated that controller 30 could readily embody a general power system microprocessor capable of controlling numerous power system functions and modes of operation. Various other known circuits may be associated with controller 30, including power supply circuitry, signal-conditioning circuitry, solenoid driver circuitry, communication circuitry, and other appropriate circuitry. Controller 30 may also be in communication with a timer 31 for measuring elapsed times between a first event and a second event. Controller 30 may be configured to adjust operational parameters of power source 10, for example, air/fuel intake ratio, injection of fuel additives, exhaust gas recirculation, and/or air injection into the exhaust manifold 15, based, at least partly, on inputs received from exhaust sensor 21. In other embodiments, controller 30 may be configured to direct warning and/or maintenance signals to an operator of a machine that includes power source 10 based on input from exhaust sensor 21. For example, for a DOC to properly function, controller 30 may utilize one or more exhaust sensors 21, such as oxygen sensors, to monitor oxygen content in the exhaust gas. Exhaust sensors 21 may be positioned before and/or after the DOC along the length of exhaust passage 22. Controller 30 may adjust a quantity of fuel injected into power source 10, which in turn may change the concentration of oxygen in the exhaust gas produced by power source 10. In this manner, controller 30 may adjust the fuel injection such that there is an optimal amount of oxygen in the exhaust gas as is required for the catalytic conversation by the DOC. In another example, for an SCR to properly function, controller 30 may determine the appropriate amount of reductant fluid to be injected based partly on the concentration of $NO_x$ in the exhaust gas. The concentration of $NO_x$ may be sensed by exhaust sensor 21, such as a $NO_x$ sensor. In this example, if exhaust sensor 21 detects that the concentration of $NO_x$ in the exhaust gas is too high, controller 30 may increase the amount of injected reductant fuel. This increase in injected reductant fuel may in turn result in an increase in $NO_x$ reduction at the SCR.

In some embodiments, the effectiveness of adjusting operational parameters of power source 10 based on inputs received from exhaust sensor 21 may depend on the accuracy of the signals received from exhaust sensors 21. In some embodiments, controller 30 may determine a placement-related parameter of exhaust sensor 21 as part of assessing the accuracy of signals generated by exhaust sensor 21. Such a placement-related parameter may be any parameter related to the physical setting, location, orientation, and/or configuration of exhaust sensor 21. Such placement-related parameters may include, for example, a distance of exhaust sensor 21 from power source 10, an angular orientation of exhaust sensor 21 relative to the surface of exhaust passage 22, and/or a radial position of exhaust sensor 21. In some embodiments, the placement-related parameter of exhaust sensor 21 may not be precisely known. In such embodiments, control subunit 26 may be configured to estimate and/or otherwise determine one or more placement-related parameters of exhaust sensor 21.

Specifically, in some embodiments, controller 30 may be in communication with at least one exhaust sensor 21, such as one that measures the concentration of a constituent (e.g., $NO_x$, $SO_x$, and/or $O_2$) of the exhaust gas. Controller 30 may also be in communication with one or more operational sensors 14 that measures one or more operational parameters (e.g., fueling state) of power source 10. Utilizing information generated by operational sensor 14 and/or exhaust sensor 21, controller 30 may be configured to determine a placement-related parameter of exhaust sensor 21, such as a distance between power source 10 and exhaust sensor 21. For the purposes of this disclosure, the distance between power source 10 and exhaust sensor 21 may be defined as the length of exhaust passage 22 between an outlet port 36 of power source 10 and a sensing component or inlet of exhaust sensor 21. In some embodiments, the outlet port 36 may be an outlet port of turbocharger 13. In some embodiments, the controller 30 may calculate the placement-related parameter based on inputs received from exhaust sensor 21, operational sensor 14, and/or timer 31. For example, in some embodiments, timer 31 may be given a command from controller 30 to track an elapsed time. Timer 31 may begin tracking the elapsed time when a change occurs in an operational parameter as sensed by operational sensor 14. Timer 31 may stop tracking the elapsed time when a change occurs in an exhaust parameter as sensed by exhaust sensor 21, wherein the change in the exhaust parameter corresponds with the change in the operational parameter. For example, timer 31 may start tracking elapsed time when operational sensor 14 senses increased fueling of power source 10, and may stop tracking elapsed time when exhaust sensor 21 senses a corresponding increase in the concentration of $NO_x$ in the exhaust gas at the location of exhaust sensor 21. Controller 30 may receive a signal representing this elapsed time from timer 31. In some embodiments, the elapsed time that occurs between the change in the operational parameter and the change in the exhaust parameter depends partly on an exhaust rate parameter of the exhaust gas. The exhaust rate parameter may be one of a subset of exhaust parameters that relates to a rate parameter of the exhaust gas. The exhaust rate parameter may include a linear-flow rate, a rotational-flow rate, a heat-conduction rate, and/or a pressure propagation rate of the exhaust gas. For example, controller 30 may use the mass flow rate of the exhaust gas as described above as an exhaust rate parameter. In various embodiments, controller 30 may calculate, measure, predict, model, and/or otherwise determine the exhaust rate parameter according to any known methods. For example, controller 30 may determine the exhaust rate parameter using exhaust parameters and/or operational parameters detected by exhaust sensor 21 and/or operational sensor 14.

Figure 2:
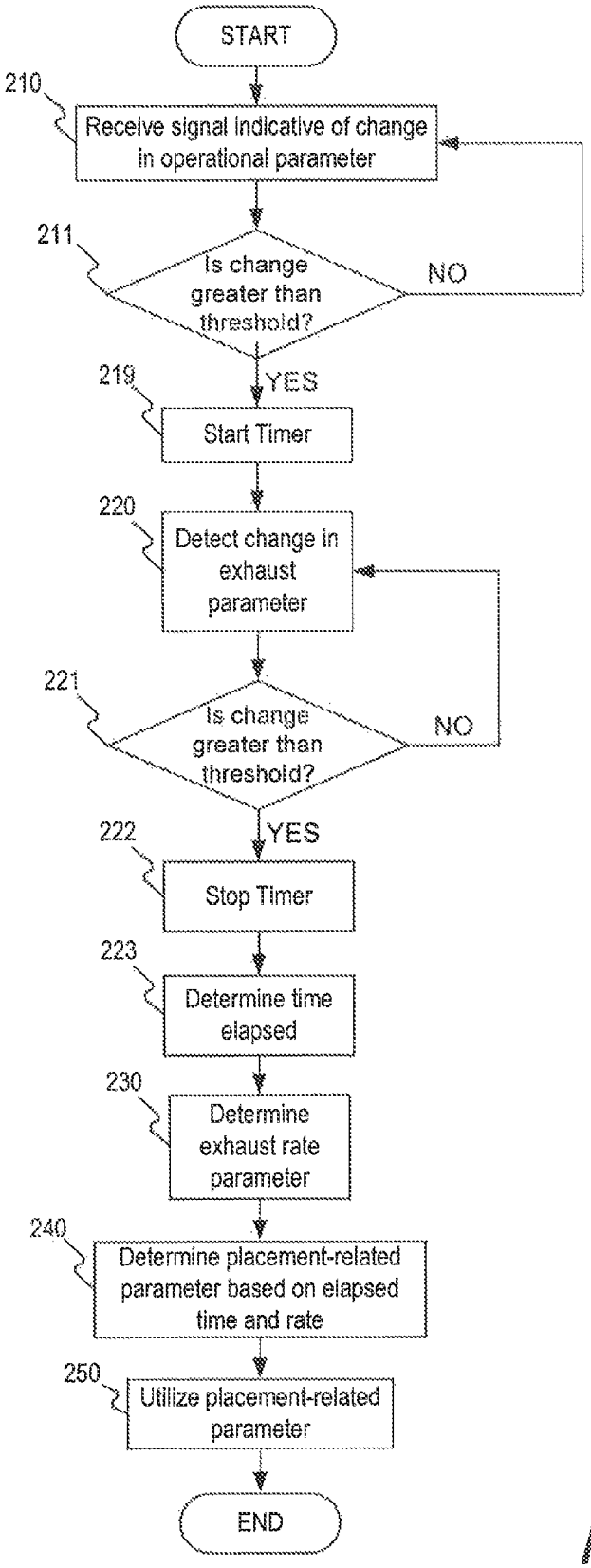
FIG. 2 is a flowchart of an exemplary method of operating the exhaust control system of FIG. 1.

FIG. 2 illustrates an exemplary method, performed by exhaust control system 8, of determining a placement-related parameter of exhaust sensor 21. FIG. 2 will be discussed in more detail in the following section to further illustrate the disclosed concepts.

INDUSTRIAL APPLICABILITY

The disclosed exhaust control system 8 may be applicable to any power source 10 and exhaust apparatus 16 where calibration and/or validation of the accuracy of components is desired. Specifically, the disclosed exhaust control system 8 may check for proper placement of sensors and/or other like system components. The exhaust control system 8 may check for the proper placement of components at various times, such as at the startup of power source 10, in response to manual instruction, and/or at regular intervals during operation of exhaust control system 8.

As shown in the exemplary embodiment of FIG. 2, at Step: 210, controller 30 may receive a signal indicative of a change in an operational parameter of power source 10, as detected and/or measured by operational sensor 14. In an exemplary embodiment where controller 30 may be configured to determine a placement-related parameter that comprises the distance between exhaust sensor 21 and power source 10, operational sensor 14 may measure an operational parameter related to fueling state, such as whether power source 10 is in a high-fueling state or low fueling state. In some embodiments, a high-fueling state may correspond to when controller 30 directs fuel injectors to inject a volume of fuel into power source 10 that is above a threshold volume, such as 50 cubic millimeters. A low-fueling state may correspond to when controller 30 directs fuel injectors to inject a volume of fuel into power source 10 that is below a threshold volume, such as 50 cubic millimeters. In various other embodiments, the threshold may be higher or lower than 50 cubic millimeters. In such embodiments, the operational parameter related to fueling state may be, for example, a rate of fuel injection and/or amount of fuel injection into power source 10. Operational sensor 14 may be one or more sensors that measure a fuel injection rate and/or volume. In embodiments in which operational sensor 14 comprises a fuel storage pressure sensor, controller 30 may use the pressure of stored fuel determined by operational sensor 14 to determine the flow rate of the fuel from the fuel injector. Operational sensor 14 may also comprise a high-speed clock for measuring how long a fuel injector injects fuel. Using the flow rate of the fuel and the time the fuel injector is kept open as inputs, controller 30 may determine the volume of fuel injection by multiplying the flow rate by the time the injector is energized to inject fuel. In such embodiments, controller 30 may determine a change in fueling state based on this determined volume of fuel injection, and proceed to Step: 219. In some embodiments, controller 30 may not proceed to Step: 219 until controller 30 determines, at Step: 211, that the change in the operational parameter exceeds a configurable threshold, such as a percentage of the difference between the fuel-injection rate and/or volume when power source 10 is idling and the fuel-injection rate and/or volume when power source 10 is outputting maximum power. If controller 30 determines that the change in the operational parameter exceeds the threshold (Step: 211: YES), then controller 30 may start timer 31 at Step: 219 to begin tracking elapsed time. If controller 30 determines that the change in the operational parameter does not exceed the threshold (Step: 211: NO), then controller 30 may continue to receive signals indicative of a change in an operational parameter from operational sensor 14 at Step: 210.

In some embodiments, the change in the operational parameter detected at Step: 210 may correlate to a change in an exhaust parameter of the exhaust gas, as detected by exhaust sensor 21. In the exemplary embodiment above, in which controller 30 determines the distance between exhaust sensor 21 and power source 10 based on fueling state of power source 10, when controller 30 directs more fuel to be injected into power source 10, power source 10 may be operating in a high-fueling state. As a result, an increase in combustion may occur in power source 10, and power source 10 may produce and output an increased amount of exhaust gas, including $NO_x$. Therefore, the concentration of $NO_x$ may increase in power source 10, and may consequently increase within exhaust passage 22, including at the location of exhaust sensor 21.

In some embodiments, there may be an elapsed time between the detection of change in the operational parameter by operational sensor 14 and the detection of change in the exhaust parameter by exhaust sensor 21. This elapsed time may be indicative of the placement-related parameter of exhaust sensor 21. For example, an elapsed time between when power source 10 begins a transition from a low-fueling state to a high-fueling state and when exhaust sensor 21 detects an increase in $NO_x$ concentration may be indicative of a distance the $NO_x$ gas travels along exhaust passage 22. Such a distance may be, for example, from where the exhaust gas was generated in power source 10 to where the exhaust gas arrives at exhaust sensor 21. In various embodiments, at Step: 219 controller 30 may send a signal to timer 31 to start tracking time or to record a start time when controller 30 detects the change in the operational parameter of power source 10.

At Step: 220, exhaust sensor 21 may detect a change in the exhaust parameter resulting from a change in operation of power source 10, and at Step: 222, in response to exhaust sensor 21 detecting the change in the exhaust parameter, controller 30 may send a signal to timer 31 to stop tracking time or record a stop time. In various embodiments, controller 30 may not proceed to Step: 222 unless controller 30 determines, at Step: 221, that the change in the exhaust parameter is above a minimum threshold. For example, the change from a low concentration of generated $NO_x$ corresponding to the low fueling state of power source 10 to a high concentration of $NO_x$ corresponding to the high fueling state of power source 10 may be relatively gradual. In such embodiments, signals from exhaust sensor 21 that correspond to a change in $NO_x$ concentration may occur at a finite rate over a finite time, between a low concentration and a high concentration. In such embodiments, controller 30 may choose to stop timer 31 at a time at which the concentration of $NO_x$ has changed by a predetermined percentage of the difference between low concentration and high concentration. In other embodiments, other known methods of choosing a point at which to stop timer 31 may be used. If controller 30 determines that the change in the exhaust parameter exceeds the threshold (Step: 221: YES), then controller 30 may stop timer 31. If controller 30 determines that the change in the exhaust parameter does not exceed the threshold (Step: 221: NO), then controller 30 may continue to receive signals indicative of a change in the exhaust parameter from exhaust sensor 21 at Step: 220.

At Step: 223, controller 30 may determine an elapsed time, for example, based on the start and stop times tracked by timer 31. For example, controller 30 may subtract the start time from the stop time. In other embodiments, timer 31 may be configured to directly measure the elapsed time and may transmit the elapsed time to controller 30.

In some embodiments, the elapsed time that occurs between the change in the operational parameter and the change in the exhaust parameter depends partly on an exhaust rate parameter of the exhaust gas. In some embodiments, controller 30 may determine the exhaust rate parameter at Step: 230. For example, in the exemplary embodiment discussed above in which the placement-related parameter comprises the distance between power source 10 and exhaust sensor 21, controller 30 may determine a mass flow rate of the exhaust gas in Step: 230, where the mass flow rate of the exhaust gas is the exhaust rate parameter. In some embodiments, controller 30 may determine the exhaust rate parameter by receiving measurement signals of the exhaust rate from operational sensor 14. In other embodiments, at Step: 230 controller 30 may calculate the mass flow rate of the exhaust gas based on the temperature and pressure of the exhaust gas, as measured by operational sensors 14 that are temperature and pressure sensors. For example, the calculation of the mass flow rate using temperature and pressure measurements may be based on Equation (1):

$$\dot{m} = \frac{mP}{nRT} \cdot \dot{V} \qquad \text{Equation (1)}$$

where $\dot{m}$ is the mass flow rate, m is mass of the exhaust gas (calculable or estimatable from known properties of the exhaust gas, for example, density of exhaust gas constituents, proportions of constituents present in the exhaust gas based on ideal combustion), P is the exhaust gas pressure (measured by operational sensor 14), n is the number of molecules of exhaust gas, R is a gas constant, T is the temperature of the exhaust gas (measured by operational sensor 14), V is the volume of the exhaust gas (volume of exhaust passage 22), and $\dot{V}$ is the volumetric flow of the exhaust gas (may be measured by operational sensor 14). In further exemplary embodiments, other known methods of determining the mass flow rate may also be used.

In various embodiments, Step: 230 may be performed before, after, or simultaneously with Steps: 219 to 223. After controller 30 has determined an elapsed time at Step: 223 and an exhaust rate parameter at Step: 230, controller 30 may determine the placement-related parameter of exhaust sensor 21, at Step: 240, based on the elapsed time and the exhaust rate parameter. For example, in exemplary embodiments, controller 30 may determine the distance between power source 10 and exhaust sensor 21 as the placement-related parameter, using Equation (2):

$$x = \frac{t \cdot \dot{m}}{w \cdot \text{area}} \qquad \text{Equation (2)}$$

where x is the distance between power source 10 and exhaust sensor 21, t is the elapsed time measured by timer 31 between generation of the exhaust gas by power source 10 and detection of the exhaust gas by exhaust sensor 21, $\dot{m}$ is the mass flow of the exhaust gas as calculated or measured in Step: 230, w is the weight of the exhaust gas, and area is the area of the cross-section of exhaust passage 22.

Once controller 30 has determined the placement-related parameter of exhaust sensor 21, control sub-unit 26 may utilize the determined placement-related parameter at Step: 250. For example, at Step: 250, control sub-unit 26 may output a warning signal to an operator when control sub-unit 26 determines that the placement-related parameter is outside an acceptable operating range. In another example, control sub-unit 26 may adjust the timing or performance of a system component based on the determined placement-related parameter. For example, exhaust sensor 21 may be a ceramic gas sensor that is heated when in operation. If the heated ceramic gas sensor comes into contact with liquid water, the heated ceramic gas sensor may crack. Liquid water may be present in the exhaust gas if the temperature of the exhaust gas is not high enough. The temperature of the exhaust gas may not be high enough for operation of exhaust sensor 21 depending on the position of exhaust sensor 21 in exhaust passage 22. For example, a exhaust sensor 21 positioned further downstream from power source 10 in exhaust passage 22 may be exposed to exhaust gas with a cooler temperature than a exhaust sensor 21 positioned relatively closer to power source 10. The inlet to exhaust sensor 21 may have a cover that may be opened and/or closed to control the exposure of exhaust sensor 21 to the exhaust gas. Control sub-unit 26 may delay or prevent the opening of this cover based on the placement-related parameter determined by controller 30. In such an example, the placement-related parameter may indicate that exhaust sensor 21 is positioned in exhaust passage 22 outside an acceptable range required by design specifications of exhaust sensor 21. Exposing exhaust sensor 21 to the exhaust gas in such a situation may result in the malfunction and/or damage of exhaust sensor 21. Therefore, preventing or delaying the opening of the cover to exhaust sensor 21 may preserve proper functioning of exhaust sensor 21 and improve the operation, performance, accuracy, and/or durability of exhaust apparatus 16 and/or power source 10.

It will be apparent to those skilled in the art that various modifications and variations can be made to the disclosed exhaust system without departing from the scope of the disclosure. For example, in some embodiments, the change in operational parameter in Step: 210 may comprise a change from a high-fueling state to low-fueling state. In other examples, the exhaust parameter may comprise the temperature of the exhaust gas, the pressure of the exhaust gas, and/or the concentration of oxygen, $SO_x$, or ammonia in the exhaust gas. In yet other examples, the placement-related parameter may comprise the orientation of an exhaust sensor 21.

Other embodiments of the exhaust system will be apparent to those skilled in the art from consideration of the specification and practice of the exhaust system disclosed herein. It is intended that the specification and examples be considered as exemplary only, with a true scope of the disclosure being indicated by the following claims and their equivalents.

What is claimed is:

1. An exhaust control system for use with a combustion engine, comprising:

an exhaust passage configured to receive a flow of an exhaust gas from the combustion engine;

an exhaust sensor associated with the exhaust passage and configured to generate a first signal indicative of an exhaust parameter of the exhaust gas;

an operational sensor associated with the combustion engine and configured to generate a second signal indicative of an operational parameter of the combustion engine; and a controller associated with the combustion engine, the exhaust sensor, and the operational sensor, the controller being configured to:

detect a change in the operational parameter of the combustion engine based on the second signal;

detect a change in the exhaust parameter of the exhaust gas based on the first signal;

measure an elapsed time between detection of the change in the operational parameter and the detection of change in the exhaust parameter; and calculate a placement-related parameter of the exhaust sensor using the elapsed time and an exhaust rate parameter comprising a mass flow rate of the exhaust gas.

2. The exhaust control system of claim 1, wherein the exhaust parameter comprises a concentration of a constituent of the exhaust gas.

3. The exhaust control system of claim 2, wherein the constituent comprises at least one of $NO_x$, $O_2$, $SO_x$, and ammonia.

4. The exhaust control system of claim 1, wherein the exhaust sensor comprises at least one of a $NO_x$ sensor, an $O_2$ sensor, a $SO_x$ sensor, and an ammonia sensor configured to detect a concentration of $NO_x$, $O_2$, $SO_x$, and ammonia in the exhaust gas, respectively.

5. The exhaust control system of claim 1, wherein the operational parameter comprises a fueling state of the combustion engine.

6. The exhaust control system of claim 1, wherein the placement-related parameter of the exhaust sensor comprises a distance along the exhaust passage between an inlet of the exhaust sensor and an outlet of the combustion engine.

7. The exhaust control system of claim 1, wherein the controller is further configured to calculate the exhaust rate parameter using measurements from one or more sensors configured to detect at least one parameter of the exhaust gas or the operation of the combustion engine.

8. The exhaust control system of claim 1, wherein the controller is further configured to output a warning signal to an operator when the placement-related parameter of the exhaust sensor is outside of an operating range.

9. The exhaust control system of claim 1, wherein the operational sensor comprises at least one sensor configured to detect an amount of fuel being injected into the combustion engine.

10. A method, performed by a processor, of determining a placement-related parameter of an exhaust control system, comprising:

detecting a change in an operational parameter of an engine using an operational sensor associated with the engine;

detecting a change in an exhaust parameter of an exhaust gas of the engine at a location downstream of the engine using an exhaust sensor associated with an exhaust passage configured to receive a flow of an exhaust gas from the engine;

measuring an elapsed time between determining the change in the operational parameter and determining the change in the exhaust parameter;

calculating, by the processor, the placement-related parameter using the elapsed time and an exhaust rate parameter comprising a mass flow rate of the exhaust gas; and activating a warning indicator, configured to alert a user of improper placement of the exhaust sensor, when the placement-related parameter is not within an expected range.

11. The method of claim 10, wherein the operational parameter comprises a fueling state of the engine.

12. The method of claim 10, wherein the exhaust parameter comprises a concentration of a constituent of the exhaust gas.

13. The method of claim 12, wherein the constituent comprises at least one of $NO_x$, $O_2$, $SO_x$, and ammonia.

14. The method of claim 10, wherein the placement-related parameter comprises a distance along an exhaust passage of the engine between an inlet of an exhaust sensor and an outlet of a combustion engine.

15. The method of claim 10, further comprising calculating the exhaust rate parameter using measurements from one or more sensors configured to detect at least one parameter of the exhaust gas or the operation of the combustion engine.

16. The method of claim 10, further comprising outputting a warning signal to an operator when the placement-related parameter is outside of an operating range.

17. A power system, comprising:

an engine configured to combust fuel and generate combustion exhaust gas;

an exhaust passage configured to receive a flow of the exhaust gas from the engine;

an exhaust sensor associated with the exhaust passage and configured to generate a first signal indicative of an exhaust parameter of the exhaust gas;

an operational sensor associated with the engine and configured to generate a second signal indicative of an operational parameter of the engine; and a controller in communication with the engine, the exhaust sensor, and the operational sensor, the controller being configured to:

detect a change in the operational parameter based on the second signal;

detect a change in the exhaust parameter based on the first signal;

measure an elapsed time between the detection of the change in the operational parameter and the detection of change in the exhaust parameter; and calculate a placement-related parameter of the exhaust sensor using the elapsed time and an exhaust rate parameter comprising a mass flow rate of the exhaust gas.

18. The power system of claim 17 wherein the exhaust parameter comprises a concentration of a constituent of the exhaust gas, the operational parameter comprises a fueling state of the engine, and the placement-related parameter comprises a distance along the exhaust passage between an inlet of the exhaust sensor and an outlet of the engine.

* * * * *